US007596892B2

(12) United States Patent
Ruuska

(10) Patent No.: US 7,596,892 B2
(45) Date of Patent: Oct. 6, 2009

(54) BLADE FOR A SNOW PLOUGH

(75) Inventor: Mauno Ruuska, Roismala (FI)

(73) Assignee: Hagie Manufacturing Company, Clarion, IA (US)

( * ) Notice: Subject to any disclaimer, the term of this patent is extended or adjusted under 35 U.S.C. 154(b) by 0 days.

(21) Appl. No.: 11/576,976

(22) PCT Filed: Oct. 11, 2005

(86) PCT No.: PCT/FI2005/000435

§ 371 (c)(1),
(2), (4) Date: Jan. 11, 2008

(87) PCT Pub. No.: WO2006/040397

PCT Pub. Date: Apr. 20, 2006

(65) Prior Publication Data

US 2008/0163522 A1 Jul. 10, 2008

(30) Foreign Application Priority Data

Oct. 11, 2004 (FI) ..... 20041313

(51) Int. Cl.
*E01H 5/06* (2006.01)

(52) U.S. Cl. ..... 37/266; 37/279; 37/281; 37/283; 37/233; 172/823

(58) Field of Classification Search ..... 37/266, 37/279–281, 283
See application file for complete search history.

(56) References Cited

U.S. PATENT DOCUMENTS

| | | | | | |
|---|---|---|---|---|---|
| 3,650,054 | A * | 3/1972 | Hanson | 37/232 |
| 4,019,587 | A * | 4/1977 | Meisel, Jr. | 172/815 |
| 4,385,458 | A * | 5/1983 | Pitti | 37/281 |
| 4,837,951 | A * | 6/1989 | Verseef | 37/197 |
| 5,018,284 | A * | 5/1991 | Mikami et al. | 37/233 |
| 5,025,577 | A * | 6/1991 | Verseef | 37/280 |
| 5,048,207 | A * | 9/1991 | Verseef | 37/281 |
| 5,079,866 | A * | 1/1992 | Farrell | 37/283 |
| 5,477,600 | A * | 12/1995 | Houle et al. | 37/279 |
| 5,638,617 | A * | 6/1997 | Belanger et al. | 37/270 |
| 6,073,371 | A * | 6/2000 | Goos et al. | 37/232 |
| 6,435,580 | B1 * | 8/2002 | Lock | 294/54.5 |
| 6,564,479 | B1 * | 5/2003 | Vickers | 37/233 |
| 6,941,685 | B2 * | 9/2005 | Goy et al. | 37/232 |

* cited by examiner

*Primary Examiner*—Thomas A Beach
*Assistant Examiner*—Matthew R Buck
(74) *Attorney, Agent, or Firm*—Stites & Harbison PLLC; Douglas E. Jackson

(57) ABSTRACT

A blade (3) meant to work in the curved form of a snow plough and attached from its lower edge to a rigid beam, the upper edge of which is supported by means of upper beam (12) or similar, and said blade is of flexible material, as plastic sheet. The blade is from its upper beam (12), essentially from its middle, supported by suspension means (9), which due to the ploughing load allows upper beam (12) and blade (3) upper edge to tilt and blade (3) to change the radius of curvature at least from the suspension spot on the blade area toward the blade point.

7 Claims, 2 Drawing Sheets

BLADE FOR A SNOW PLOUGH

Figure 1:
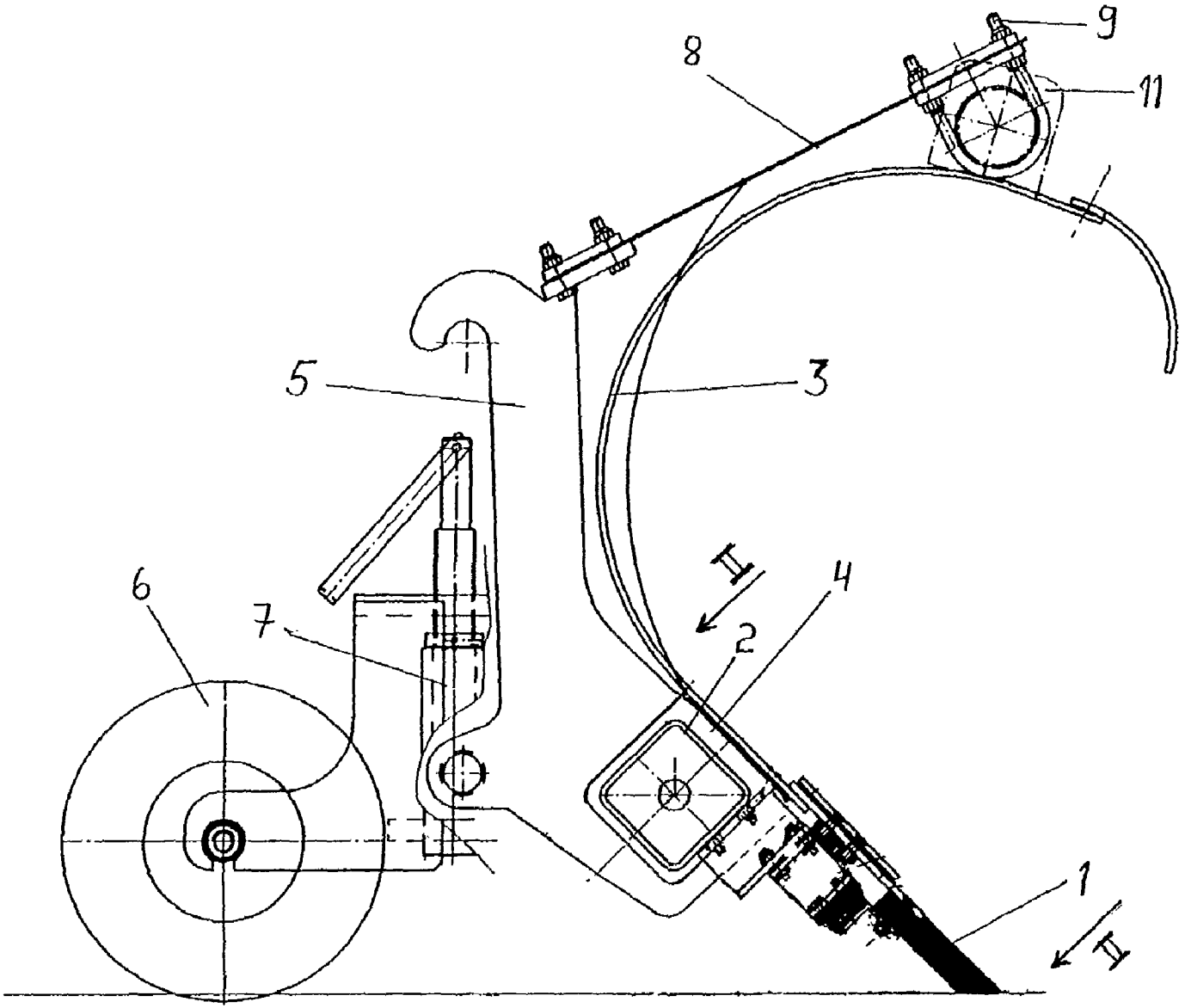

The invention relates to a blade intended to work in the curved form of a snow plough, and the blade is from its lower edge fixed to a rigid beam and the upper edge of which is supported by the upper beam or similar and the said blade is of flexible material, as plastic sheeting. The blade portion of the snow plough shifts snow lifted on to it by the plough colter, from the area to be ploughed to the side of the snow plough. The aim is to shift snow effectively by means of mall ploughing force, a clean mark of job without snow getting over the blade and control of the formation of the plough bank.

The flow of snow on the blade depends on the ploughing speed. By lower speeds the snow moves on the blade lower edge and along it not rising on the blade. It happens especially by small ploughing quantities of snow. By growing speed the snow rises onto the blade and falls down, while the course of snow is screw like. By most speedy ploughing the snow rises only once onto the blade and continues then thrown in the blade direction.

The temperature and water content of snow and the quantities to be ploughed do change. This makes quite different demands on the form and size of the snow plough blade The friction between blade and snow with its variations is an influential factor. of ploughing.

Light and dry frozen snow and smaller snow quantities are best ploughed with a relatively low blade turning down from the front. It is important to prevent light snow to get over the blade and to minimize turbulence at the back of the blade.

When snow quantity, specific weight the of snow quantity, water quantity and temperature of snow rise the firmness and ploughing resistance of snow increase. Then a higher blade with bigger bending radius, most preferably broadening conically, ploughs most effectively.

For moving snow by faster ploughings the most reasonable and most aimed form of blade is a cone broadening in the trailing direction. Then the blade shifts the snow a longer way only by one rise, while the quantity of snow grows. By sufficient speed for throwing snow the most reasonable direction diagonally upwards can be achieved. On the other hand, the shallowness of the forepart of the blade is an advantage by speedy ploughing, since the turbulence arising at the back of blade remains smaller.

Slight friction between snow and blade facilitates the sliding of snow motion on the blade without snow gathering to get pushed in front of the blade into a heap to be mixed. The snow sliding on the blade begins to move to the sides and the width of the snow plough can be used with minimum overlap in regard to former ploughing width.

Same snow ploughs are used for ploughing on the right and on the left side and then conicality is needed in both directions. A known solution is achieved making in both ends of the cylindrical blade portion growing cylindrical blade extensions. There will be discontinuities in he blade, the blade forepart looses a part of its optimal form and it is high with its turbulence at the back.

Another known solution is a conical blade with knives in upper and lower edges and the whole cone is turned around an axle in direction of the longitudinal axle of the plough vehicle for achieving the ploughing direction wanted. The disadvantage of this solution is the great lifting height, especially with greater ploughs and double colter constructions.

Further, a known solution is to use a flexible blade attached from its lower and its upper edge to rigid beams and the upper beam is moved in regard to the lower beam by means of levers and hydraulic cylinders so that it is possible to make the blade broaden into a cone in wanted direction. The disadvantage here is complicated mechanical constructions and need for control according to the direction of work.

According to the solution of this invention the flexible form of the snow plough changes automatically from cylindrical into a broadening cone, when the load of snow grows on the blade. The snow plough according to this invention is characterized in that the blade is from its upper beam, essentially from its middle, supported by suspension means, which due to the ploughing load allows the upper beam and blade upper edge to tilt and the blade to change the radius of curvature at least at the suspension on the blade area towards the blade point. According to the flexible attachment of the upper beam of this invention it is possible to get the upper beam motion automatically in the right direction. The upper beam that supports the blade is attached flexibly in regard to the lower beam. The direction of motion is determined by the direction flexible motion and the size by the stiffness of spring and the snow load getting to the blade. By higher driving speeds and greater snow quantities centrifugal force is directed on the blade, which force tends to lift the blade from its upper edge. The blade gets up especially in the trailing end of the plough blade, because of the impact of its greater snow quantity.

The advantage of the solution is the low cylindrical form of blade lifted up by transportation, whereby its visual obstruction is small compared to high form. By fast ploughing the conical form of the blade is of no benefit and the blade remains low. There is less turbulence at the back of the blade than with a high blade. By ploughing there is most snow in the blade trailing end and due to it the buoyancy caused by the snow whirl is at greatest in it causing most buoyancy forces, which open the blade into a growing cone. At the same time this produces the right direction of conicality.

Anyhow, the blade lifting force is a disturbing property, since at its worse, it tends to lift up the whole plough, whereby the cutting force weakens and at the same time the snow-removing property of the plough weakens. The blade opening into a broadening cone reduces the plough colter forces with no need for separate colter force control. The broadening blade cone reduces the rises of snow onto the blade by ploughings with average speeds and thus the quantity of ploughing capacity needed. With same plough capacity greater snow quantities as with a cylindrical blade can be shifted.

In the following the invention is disclosed with reference to the enclosed drawing where FIG. 1 shows the snow plough viewed from its end.

Figure 2:
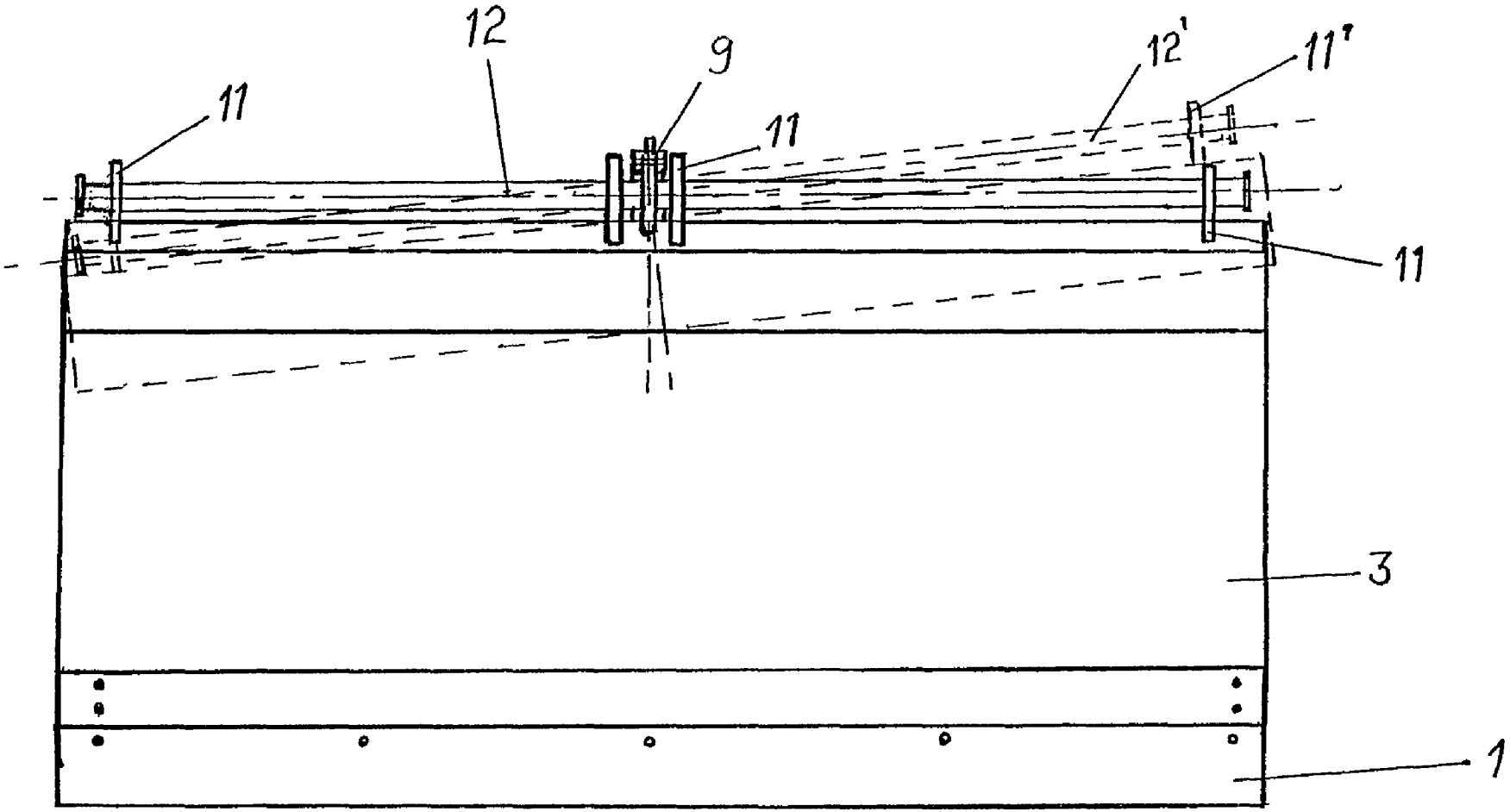

FIG. 2 shows the snow plough viewed from its front.

FIG. 1 shows snow plough 3 furnished with body 5, support wheel 6 furnished height adjusting means and colter 1 furnished with a blade 3 as its extension. Blade 3 is of flexible material and supported by means of holder 8. The blade lower edge is fixed to square formed beam 2 by means of winding band 4. Lower beam 2 does wind, so thus the lower edge of blade 5 is stiff The upper edge of the flexible blade is with brackets 11 attached to rigid beam 12, which can wind in regard to round balk 12. This construction enables change of blade form from cylinder to broadening cone.

When according to FIG. 2 the blade is locked lengthwise only from the middle, brackets 11 in upper beam 12 and also pieces 4 in the lower edge allow sliding of blade on body beams 2 and differences of thermal extensions. Upper beam 12 is suspended on one leaf spring 8. If upper beam 12 is suspended on two leaf springs 8, so in its normal position, without forces caused by the snow, leaf springs 8 will most reliably keep upper balk 12 in lower beam 2 direction. By ploughing the snow load tilts upper beam to position 12' and at the same time the curvature of blade 3 changes. The curvature becomes more gently sloping from the suspension spot toward the blade trailing edge and becomes steeper from the suspension spot toward the blade front edge. The plastic or for instance rubber material of the blade allows bending and winding of a plate structured blade.

Due to the centrifugal force caused by the sliding snow flow on the blade more lifting forces are directed on the blade left portion and the blade back part gets up and backward, while the front part gets down and forward. The blade becomes a cone broadening in the trailing direction.

The invention claimed is:

1. A snow plough comprising:

a snow blade made of a flexible material and which works in a curved form, the snow blade having a lower edge, an upper edge, and a radius of curvature between the lower edge and the upper edge; and a suspension for the snow blade including a body, a rigid lower beam fixed to the lower edge of the snow blade and to the body, an upper beam supporting the upper edge of the snow blade, a suspension means secured to the body for suspending the snow blade from the upper beam essentially from only a near-middle suspension spot of the snow blade and for allowing the upper beam and the upper edge of the snow blade to tilt relative to the body depending on a dynamic plowing load experienced by the snow blade and hence for allowing the snow blade to dynamically change the radius of curvature at least of a blade portion extending downwardly from the suspension spot toward the lower edge.

2. A snow plough according to claim 1, wherein the blade portion which changes its curvature is attached at least to the upper edge of the snow blade.

3. A snow plough according to claim 1, wherein a winding is used to attach the blade upper edge to the upper beam, and wherein a spring is used to suspend the upper beam while allowing the change of curvature of the blade portion from the suspension spot.

4. A snow plough according to claim 1, wherein two leaf springs suspend the upper beam from the near-middle suspension spot and allow a rise and tilting of the upper beam adjacent a trailing end of the snow blade so as to change the radius of curvature of the trailing end of the snow blade into a broadening cone due to the dynamic plowing load.

5. A snow plough according to claim 1, wherein the snow blade includes a) lower brackets attached at the lower edge, which lower brackets are non windingly connected to the rigid lower beam, and b) upper brackets attached at the upper edge, which upper brackets are windingly connected to the upper beam, the upper and lower brackets being arranged to allow for changes of length due to material differences in a blade lengthwise direction.

6. A snow plough as claimed in claim 1, wherein the snow blade is a plastic sheet.

7. A snow plough as claimed in claim 1, wherein the snow blade further includes a colter secured at the lower edge thereof and an extension secured to the upper edge.

* * * * *